United States Patent [19]

Wennerblom

[11] 4,128,669

[45] Dec. 5, 1978

[54] METHOD OF SURFACE TREATING PAPER WEBS

[75] Inventor: Bengt A. Wennerblom, Piteå, Sweden

[73] Assignee: SCA Development Aktiebolag, Sundsvall, Sweden

[21] Appl. No.: 821,231

[22] Filed: Aug. 2, 1977

[30] Foreign Application Priority Data

Aug. 27, 1976 [SE] Sweden ..... 7609524

[51] Int. Cl.[2] ..... B05D 1/26; B05D 1/34

[52] U.S. Cl. ..... 427/8; 427/9

[58] Field of Search ..... 427/8, 9, 10

[56] References Cited

U.S. PATENT DOCUMENTS

| | | | |
|---|---|---|---|
| 3,649,340 | 3/1972 | Mozzi | 427/8 X |
| 3,941,902 | 3/1976 | Wennerblom et al. | 427/172 |
| 4,032,670 | 6/1977 | Warning et al. | 427/8 |

*Primary Examiner*—James R. Hoffman

*Attorney, Agent, or Firm*—Lerner, David, Littenberg & Samuel

[57] ABSTRACT

A method is provided for controlling the amount of active substance applied to the surface of a continuously-moving paper web, with the active substance being dissolved in or dispersed in a treating liquid. The paper web is passed over a coating unit and includes an opening through which the treating liquid is applied to the paper web. The method includes the steps of supplying a first fluid with a predetermined amount of active substance to a first batching device and supplying a second fluid consisting of pure solvent or dispersing agent to a second batching device. The output of the first batching device is controlled in response to the speed of the paper web to control the amount of active substance supplied to a mixer, and the output of the second batching device is controlled in response to the fluid pressure at the opening of the coating unit to control the amount of solvent or dispersing agent supplied to the mixer. Then, the outputs of the first and second batching devices are mixed to form the treating liquid, which is then supplied to the opening of the coating unit so that the paper web is completely covered with treating liquid even in sections of the paper web where the surface roughness is relatively high, as compared to the remainder of the paper web.

2 Claims, 2 Drawing Figures

METHOD OF SURFACE TREATING PAPER WEBS

BACKGROUND OF THE INVENTION

Typically, the treating liquid for the paper web is applied through an opening in a container which is slit-shaped and extends transverse to the direction of movement of the paper web. The web is passed over the slit opening through which the treating liquid is applied without return flow. An illustration of such an arrangement is shown in U.S. Pat. No. 3,941,902.

In order to obtain a coat of treating liquid which is constant per surface unit, the flow/web speed ratio can be maintained constant. This can be effected, for example, by employing a gear pump to pump treating liquid, the operation of the gear pump being coupled to the movement of the paper web, so that a change of the web speed causes the rate of flow to be adjusted accordingly. During stable operation, the flow, as well as the web speed, preferably is held constant.

However, it is impossible to obtain a coat which completely covers the paper web with a small rate of flow. In other words, to obtain a complete covering, a minimum flow or a minimum coat is required, below which minimum the web is only partially covered.

It was found that this minimum coat depends on several different variables, such as the configuration of the slit, web speed, viscosity of the treating liquid and surface roughness. In a particular case, first-mentioned variables are typically constant while the latter one, i.e., the surface roughness of the paper, can vary due to the fact that the properties of a paper web seldom are constant along the web. As it is desired to obtain a complete coverage of the entire web, it is necessary to adjust the flow/web speed ratio so that it also covers the highest surface roughness. To accomplish this, the coat is usually given an unnecessary thick coating in the remaining portions of the web, which is a substantial disadvantage, as it is inefficient and wasteful.

It was found that the liquid pressure in the slit opening varies with the degree of coating. (See FIG. 1.) At coating degrees below 100 percent, i.e., when the paper web is not covered completely, the pressure rises slowly as the degree of coating increases, whereas the pressure rises at an increased rate when the coating degree increases above 100 percent. This implies that a coating degree directly above 100 percent can be permanently ensured by maintaining the pressure in the slit constant. However, this cannot be achieved, since the pressure in the slit varies with the surface structure of the web; also, the coat of treating liquid varies with the surface structure, i.e., the amount of active substance applied varies along the paper web. Consequently, as the surface properties of the paper web are non-uniform, the pressure in the slit does not remain constant.

Broadly, it is an object of the present invention to provide a method which overcomes one or more of the aforesaid problems. Specifically, it is within the contemplation of the present invention to provide a method of surface treating paper webs which gives a uniformly thick coating of the active substance in all portions of the paper web, even in those sections having the highest surface roughness.

It is a further object of the present invention to provide a method which varies the amount of coating material applied to the paper web in response to the changing surface properties of the moving paper web.

SUMMARY OF THE INVENTION

Briefly, in accordance with the principles of the present invention, an improved method is provided for controlling the amount of active substance applied to the surface of a continuously-moving paper web, wherein the active substance is dissolved in or dispersed in a treating liquid. The method is performed on a paper web being passed over a coating unit which may be in the form of a container having an opening through which the treating liquid is applied to the paper web. The method includes the steps of supplying a first fluid with a predetermined amount of the active substance to a first batching device and supplying a second fluid consisting of pure solvent or dispersing agent to a second batching device. The output of the first batching device is controlled in response to the speed of the paper web to control the amount of active substance supplied to a mixer, and the output of the second batching device is controlled in response to the fluid pressure at the opening of the coating unit to control the amount of solvent or dispersing agent supplied to the mixer. Then, the outputs of the first and second batching devices are mixed to form the treating liquid which is supplied to the opening of the coating unit so that the paper web is completely covered with the treating liquid, but the coating of active substance remains constant over the entire web, even in those sections of the paper web where the surface roughness is relatively high compared with the remainder of the paper web.

BRIEF DESCRIPTION OF THE DRAWINGS

Further objects, features, and advantages of the present invention will become apparent upon the consideration of the following detailed description of a presently-preferred embodiment, when taken in conjunction with the accompanying drawings, wherein.

DETAILED DISCUSSION OF PREFERRED EMBODIMENT OF THE INVENTION

Figure 2:
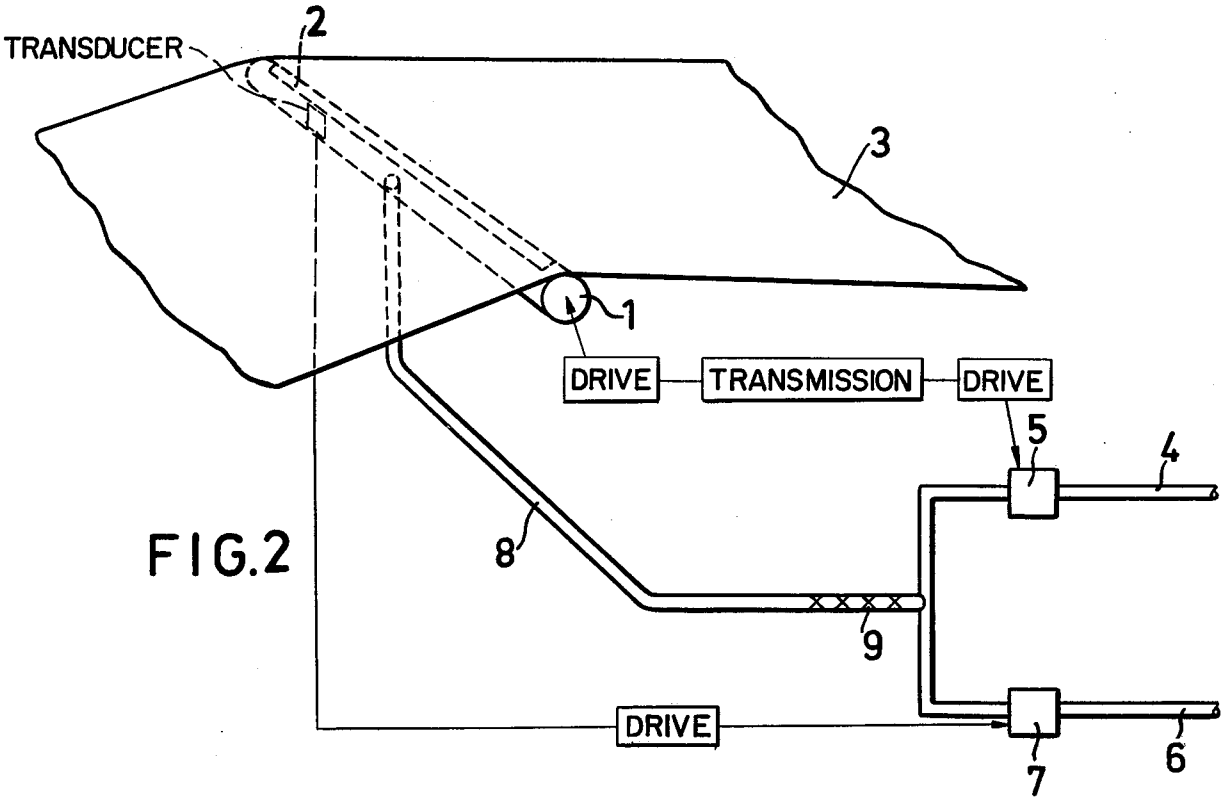
FIG. 2 shows in a schematic manner apparatus employing the method according to the present invention.

In FIG. 2 a coating unit is shown, which comprises a container 1 for treating liquid which, along its longitudinal direction, is provided with a slit-shaped opening 2, the length of which corresponds to the width of the paper web 3 to which the treating liquid is to be applied.

Through a first conduit 4 a liquid with a known content of active substance is supplied. The flow is controlled by a first adjustable batching device 5. Through a second conduit 6, a pure solvent or dispersing agent is supplied, and its flow is controlled by a second adjustable batching device 7. The two conduits 4, 4 are coupled together after the batching devices 5, 7 to a main conduit 8 leading to the container 1. In said main conduit 8, a mixing device 9 is positioned, in which the two partial flows from the conduits 4, 6 are mixed to form the treating liquid to be used for the surface treatment of the paper web.

The first batching device 5 is controlled by the speed of the web, implying the possibility of maintaining constant the amount of the web per surface unit.

The second batching device 7 is controlled by the pressure in the slit, so that the flow of the solvent or dispersing agent varies in response to the surface structure of the paper web, and a minimum amount of solvent or dispersing agent is applied. This implies, thus, that the amount of treating liquid applied per surface unit varies in response to the surface structure of the paper web, but that the coat of active substance remains constant over the entire web.

The design of the details of the application unit 1, 2 can vary from one case to another. Examples of embodiments are described in literature. For the present invention, however, it is only essential that the entire flow of coating liquid is applied to the paper web without return flow.

The surface treating principle according to the present invention can be utilized in many different applications. Examples which can be mentioned include surface coloring, surface sizing, coating, surface treatment with waxes, fuse sizes, lacquers, dispersions, and polymer solutions of various kinds. The active substance, thus, may be, e.g., a coloring substance, a binding agent, a pigment, a water-repelling agent a.s.o., or combinations of such agents, according to the desired effect of the coat.

The active substance shall be dissolved or dispersed in the solvent or dispersing agent. This is the case with the above examples. One exemption, however, may be the application of wax or fuse size where the substance usually is applied in molten state without solvent. When in such cases, especially expensive products are concerned, the process may advantageously be modified so as to permit the present invention to be applied. This would imply that the expensive active substance is batched without additive in the conduit 4 with the smallest flow required for achieving the object of the treatment. In the conduit 6, small amounts of a solvent or other cheap diluent are batched, so that full coverage is obtained even in sections of the paper web where the surface roughness is relatively high compared with the remaining web.

When coating paper webs of great width, where great varieties in the surface structure may occur across the web, the coating unit preferably is divided into several sections across the web, and the flows to each sections are controlled individually.

The adjustable batching devices 5, 7 are suitable pumps and are preferably gear or screw pumps delivering a flow proportional to the speed. It is thereby possible with simple and well-known means to adjust the speed for controlling the flow.

The flow through the batching device 5, thus, is controlled in a simple way by means of a gear or V-belt transmission from the drive of the coating unit to the drive of the pump. Preferably, a variable gear is used so as to be able to adjust the speed ratio to a desired and optimal value for obtaining the desired flow and coat.

The flow through the batching device 7 is controlled by the pressure in the slit most simply thereby that the impulse from a pressure transducer positioned in the slit opening affects the speed of the pump motor according to principles well known in control technology. At increasing pressure in the slit, the pump motor receives a signal to reduce the speed, so that the pressure reassumes the desired value.

Figure 1:
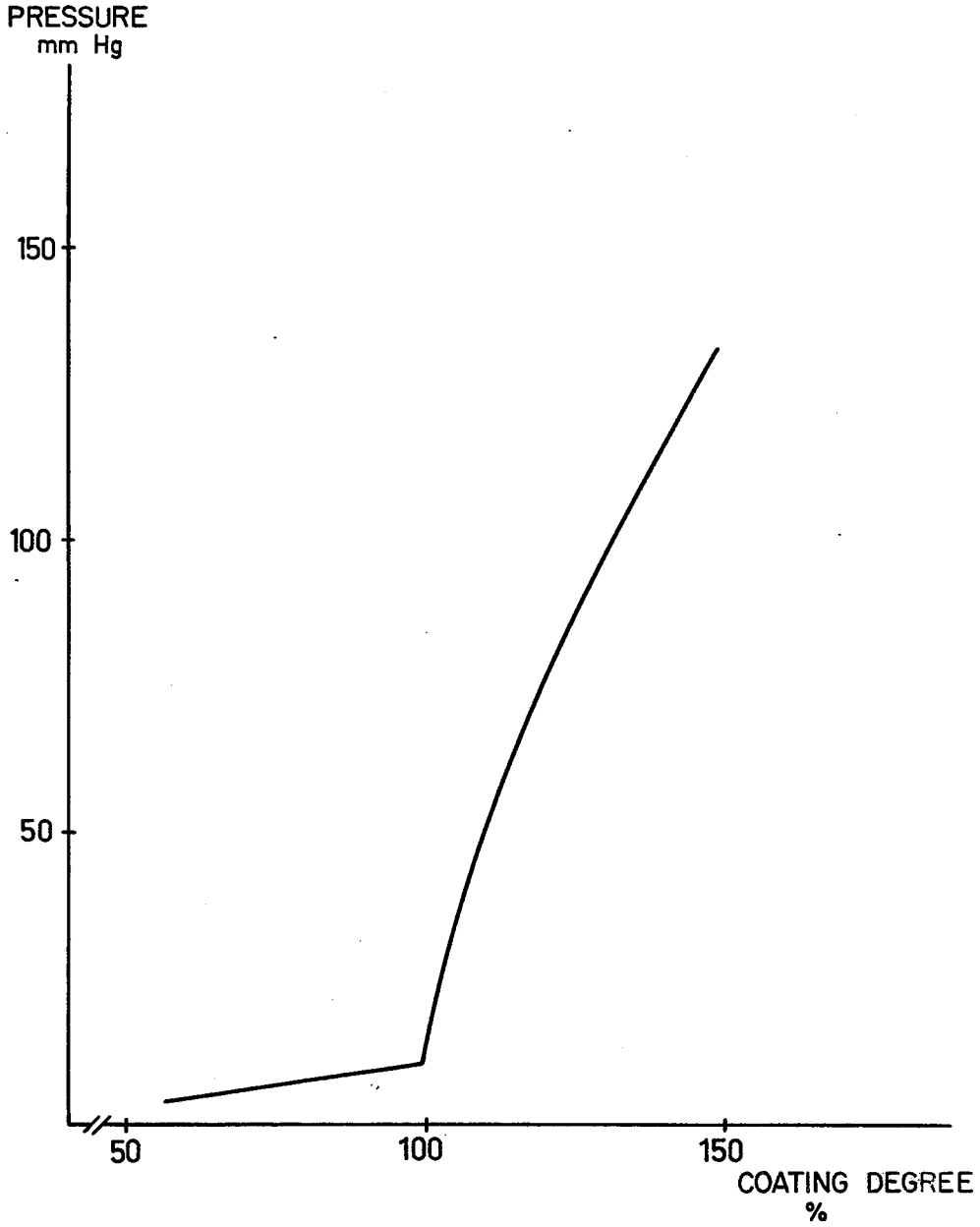
FIG. 1 shows the liquid pressure in the slit opening as a function of the coating degree at the dyeing of a paper web with water.

The choice of the pressure desired in the slit is determined by the desire that the coverage of the paper web shall be complete, but not unnecessarily high. The suitable pressure must be found empirically in each application case. At the example according to FIG. 1, a pressure of ca. 30 mm Hg would be suitable.

The mixing device 9 may consist, for example, of a container with stirrer means. Preferably, however, the mixing is effected directly in the conduit, e.g., by a so-called static mixer, which comprises a plurality of helically-wound metal sheets in series within and along the conduit.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method of controlling the amount of active substance applied to the surface of a continuously-moving paper web, said active substance being dissolved in or dispersed in a treating liquid, said paper web being passed over a coating unit in the form of a container, said container being positioned transverse to the direction of movement of said paper web and having an opening through which the treating liquid is applied to the paper web, including the steps of:

supplying a first fluid with a predetermined amount of said active substance to a first batching device, supplying a second fluid consisting of pure solvent or dispersing agent to a second batching device, controlling the output of said first batching device in response to the speed of said paper web to control the amount of active substance supplied to a mixer, controlling the output of said second batching device in response to the fluid pressure at said opening to control the amount of solvent or dispersing agent supplied to said mixer, mixing the outputs of said first and second batching devices at said mixer to form said treating liquid, and supplying said treating liquid to said openings so that said paper web is completely covered with said treating liquid.

2. A method according to claim 1 further including the step of applying treating liquid in several zones across the web, wherein the application to each zone is individually controlled.

* * * * *